US010439304B2

(12) United States Patent
Janzen

(10) Patent No.: US 10,439,304 B2
(45) Date of Patent: Oct. 8, 2019

(54) MODULAR TERMINAL BLOCK COMPRISING A CONDUCTOR GUIDE THAT CAN BE CLIPPED THEREONTO

(71) Applicant: Phoenix Contact GmbH & Co. KG, Blomberg (DE)

(72) Inventor: Wjatscheslaw Janzen, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 15/558,639

(22) PCT Filed: Mar. 11, 2016

(86) PCT No.: PCT/EP2016/055345
§ 371 (c)(1),
(2) Date: Sep. 15, 2017

(87) PCT Pub. No.: WO2016/146538
PCT Pub. Date: Sep. 22, 2016

(65) Prior Publication Data

US 2018/0076538 A1 Mar. 15, 2018

(30) Foreign Application Priority Data

Mar. 16, 2015 (DE) ..... 10 2015 103 847

(51) Int. Cl.
*H01R 9/24* (2006.01)
*H01R 9/26* (2006.01)

(52) U.S. Cl.
CPC ..... *H01R 9/2408* (2013.01); *H01R 9/2416* (2013.01); *H01R 9/2608* (2013.01)

(58) Field of Classification Search
CPC ..... H01R 9/2675; H01R 9/26; H01R 9/2608; H01R 9/2408; H01R 9/2625;
(Continued)

(56) References Cited

U.S. PATENT DOCUMENTS 5,352,136 A 10/1994 Chen
5,605,471 A 2/1997 Plyler
(Continued)

FOREIGN PATENT DOCUMENTS

CN 102084554 A 6/2011
CN 104137342 A 11/2014
(Continued)

OTHER PUBLICATIONS

English Translation of EP 1976064.*
(Continued)

*Primary Examiner* — Edwin A. Leon
*Assistant Examiner* — Matthew T Dzierzynski
(74) *Attorney, Agent, or Firm* — Reising Ethington P.C.

(57) ABSTRACT

Modular terminal block, in particular a multi-level terminal block, for clamping a plurality of jumper wires that can be led thereto in an orderly fashion using a comb-type structure. The comb-type structure can be put together from separate bars that have clip-on-portions and cooperate with mating clip-on portions on the terminal block such that the bars can be removed from the terminal block when no comb-type structure is needed.

14 Claims, 6 Drawing Sheets

(58) Field of Classification Search
CPC .. H01R 25/142; H01R 4/4818; H01R 4/4827; H01R 9/2633; H01R 13/506; H01R 4/48; H01R 4/4836; H01R 9/2416; H01R 9/2666
See application file for complete search history.

(56) References Cited

U.S. PATENT DOCUMENTS

| | | | | | |
|---|---|---|---|---|---|
| 5,668,910 | A * | 9/1997 | Arnett | G02B 6/4452 361/826 |
| 5,720,632 | A * | 2/1998 | Viklund | H01R 9/2416 361/826 |
| 6,506,071 | B2 * | 1/2003 | Lange | H01R 9/26 439/358 |
| 6,783,385 | B2 * | 8/2004 | Rudy | H01R 4/4836 439/438 |
| 8,062,076 | B2 * | 11/2011 | Henke | H01R 9/2633 439/709 |
| 8,262,373 | B2 * | 9/2012 | Reynolds | H01R 13/639 174/100 |
| 9,474,178 | B2 * | 10/2016 | Binner | H01R 9/2408 |
| 9,806,440 | B2 * | 10/2017 | Hoppmann | H01R 4/242 |

FOREIGN PATENT DOCUMENTS

| | | | | |
|---|---|---|---|---|
| DE | 2004347 | A1 | 8/1971 | |
| DE | 2042942 | A1 | 3/1972 | |
| DE | 9211879 | U1 | 11/1992 | |
| DE | 19635821 | C1 | 11/1997 | |
| DE | 202007004624 | U1 | 7/2008 | |
| DE | 102009003534 | A1 | 9/2010 | |
| EP | 0585700 | A1 | 3/1994 | |
| EP | 0828316 | A1 * | 3/1998 | H01R 9/26 |
| EP | 1811605 | A1 | 7/2007 | |
| EP | 1976064 | A2 * | 10/2008 | H01R 9/24 |
| WO | 9744860 | A1 | 11/1997 | |
| WO | 2011094108 | A1 | 8/2011 | |

OTHER PUBLICATIONS

English Translation of EP 0828316, Eggert, Mar. 11, 1998.*
WAGO Innovative Connections, Main Catalog vol. 1, 2012/2013, Reihenklemmensysteme (Serisa Terminal Systems).
German Office Action, Applicant: Phoenix Contact GmbH & Co. KG, Serial No. 10 2015 103 847.1, dated Dec. 18, 2015.
International Search Report and Written Opinion, Int. Serial No. PCT/EP2016/055345, Int. Filing Date: Mar. 11, 2016, Applicant: Phoenix Contact GmbH & Co. KG, dated Jun. 2, 2016.
English Translation of the International Preliminary Report on Patentability, Int. Application No. PCT/EP2016/055345, Int. Filing Date: Mar. 11, 2016, Applicant Phoenix Contact GmbH & Co. KG, dated Sep. 28, 2017.
1st Chinese Office Action, Application No. 201680010461.4, Applicant: Phoenix Contact GmbH & Co. KG, Applicant: Phoenix Contact GmbH & Co., dated Aug. 3, 2018.

* cited by examiner

MODULAR TERMINAL BLOCK COMPRISING A CONDUCTOR GUIDE THAT CAN BE CLIPPED THEREONTO

TECHNICAL FIELD

The present disclosure relates to a modular terminal block, in particular a multi-level terminal block, for clamping a plurality of jumper wires that are to be led to individual connection units. The multi-level terminal block has a frame housing for connection units to be mounted on top of each other and side by side and a comb-type structure for forming guiding slots for the jumper wires.

BACKGROUND

A multi-level terminal block with frame housing, with connection units and with a comb-type structure for forming guiding slots for jumper wires is known from EP 1 976 064 B1. The comb-type structure is formed by several router distribution clamps arranged side by side, the clamps being combined to a terminal block. The router distribution clamps have an insulating material housing and are provided with clip-on feet for being clipped onto a top-hat rail on which the multi-level terminal block is placed. The insulating material housing or housings form a part of both, the router distribution clamp and the frame housing of the multi-level terminal block. Therefore, it is not possible to remove individual router distribution clamps from the multi-level terminal block.

The comb-type structure with the multi-level terminal block enables a clear feeding of the wires to the particular connection units that clamp individual jumper wires. Nevertheless, it may happen that the comb-type structure is unwanted and has to be removed by breaking off, for example.

GENERAL DESCRIPTION

It is an object of the present disclosure to create a modular terminal block, in particular a multi-level terminal block, which may be put together with or without a comb-type structure.

The object of the present disclosure is solved by the subject matter of the independent claims. Advantageous refinements of the present disclosure are defined in the dependent claims.

For solving this object, the comb-type structure is put together from separate bars which are provided with clip-on portions for cooperating with mating clip-on portions at the frame housing of the modular terminal block such that these bars may be omitted, when the comb-type structure is not needed at the modular terminal block or at the multi-level terminal block, or at favoured positions of the modular terminal block or of the multi-level terminal block. Thus, it is possible to assemble terminal blocks or multi-level terminal blocks with or without the comb-type structure, at user's option.

According to a refinement of the present disclosure, several separate bars are combined in a bar assembly group, and this bar assembly group as such may be clipped onto the frame housing of the terminal block. If the modular terminal block has a certain number of connection units side by side and on top of each other, a bar assembly group with a corresponding number of guiding slots may be provided so that the modular terminal block may easily be provided with a fitting comb-type structure. Gaps between modular terminal blocks can also be bridged using bar assembly groups, when a cable channel shall be formed along such modular terminal blocks.

In detail, the clip-on portion of the bars forming the comb-type structure may each have pencil-shaped protrusion with guiding slot and undercut for cooperating with a detent spring of the frame housing of the modular terminal block and an engagement hook for cooperating with an engagement opening of the frame housing. Secure and yet easily operable clip-on connections are possible, using such clip-on portions at the comb-type structure and mating clip-on portions at the frame housing of the modular terminal block.

The bars of the comb-type structure are elastically flexible and have a longish, fingerlike shape and each have an upper, free end and a lower end, wherein the clip-on portions are fixed at the lower end, or close to that lower end. Therefore, the bars can be bent away from each other, in order to further open the guiding slots for the jumper wires, during their routing. This may be especially advantageous, if protrusion are formed as cross brackets at the upper end of the particular bars, or close to the upper end, for narrowing the guiding slots formed between the bars and for preventing the jumper wires inserted into the guiding slots from coming forth.

At the upper ends of the particular bars, or close to that ends, a protrusion can be mounted which extends out of the plane of bars arranged side by side and serves as a counter bearing of a cap or cover. Thereby, cable channels made of bars arranged side by side can be covered.

In the following, the present disclosure is described in more detail, by means of exemplary embodiments and referring to the figures, wherein same and similar elements are partially provided with same reference signs. The features of the different exemplary embodiments may be combined with each other.

BRIEF DESCRIPTION OF THE FIGURES

In the figures.

DETAILED DESCRIPTION

Figure 1:
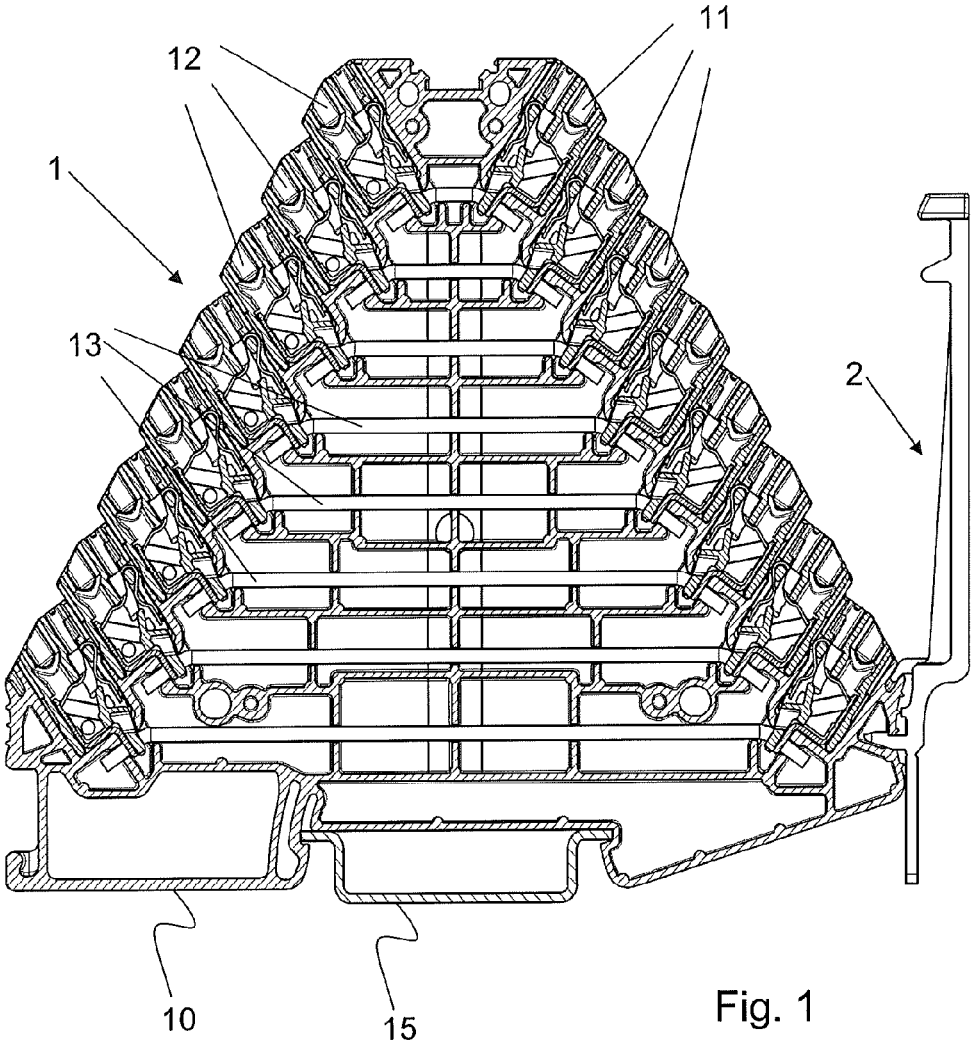
FIG. 1 is a sectional drawing of a multi-level terminal block.

FIG. 1 shows a multi-level terminal block 1 in connection with a comb-type structure 2. The multi-level terminal block 1 has a multi-level frame housing 10 and several rows of clamps forming connection units 11 for jumper wires not being shown. The rows of the connections units 11 are arranged in levels of the frame housing 10 made of insulating plastics and connected with further connection units 12 via connection lines 13, as it is known. The frame housing is placed on top of a top hat carrier rail 15 and directly clipped-on therewith.

The comb-type structure 2 (FIGS. 2, 3) serves for forming guiding slots 20 for the jumper wires not being shown, for guiding these wire in an orderly fashion to the individual connection units 11, on top of each other and side by side. The comb-type structure is assembled from individual, separate bars 21 between which the guiding slots 20 extend.

The bars 21 are clipped-on at the frame housing 10 and can easily be mounted and demounted.

Figure 2:
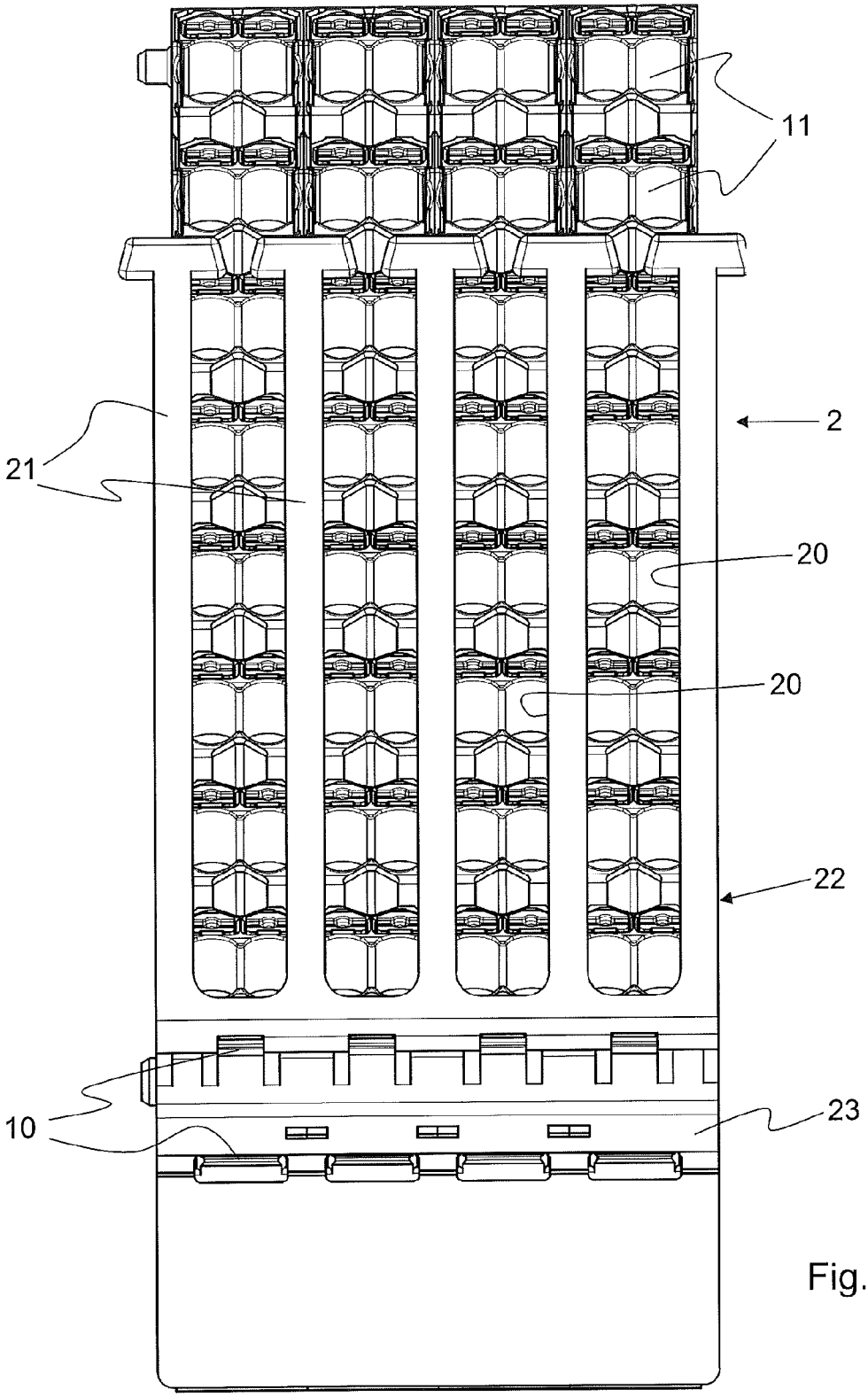
FIG. 2 is a lateral view of the multi-level terminal block.
Figure 3:
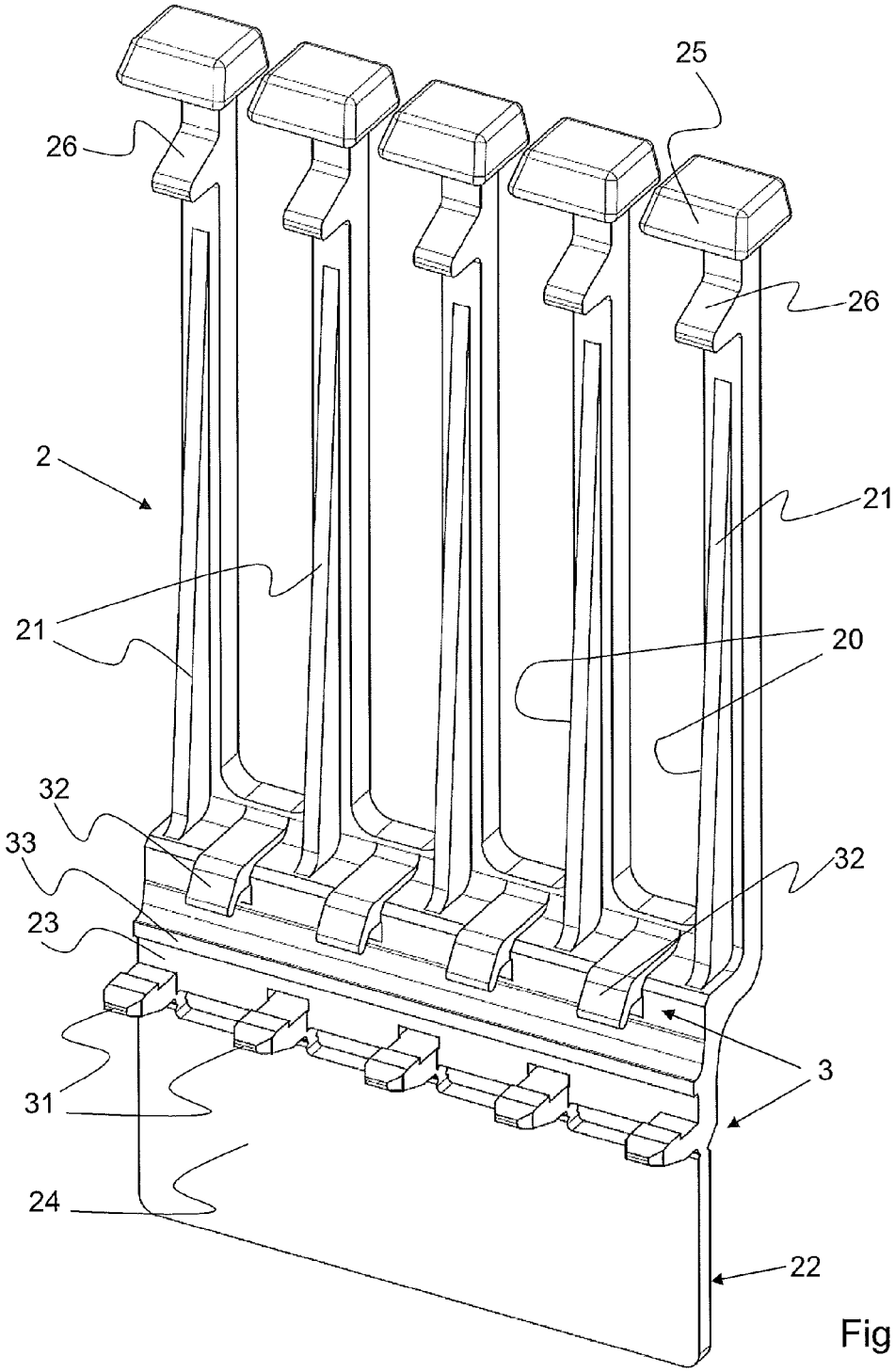
FIG. 3 is a perspective view of a bar assembly group.
Figure 5:
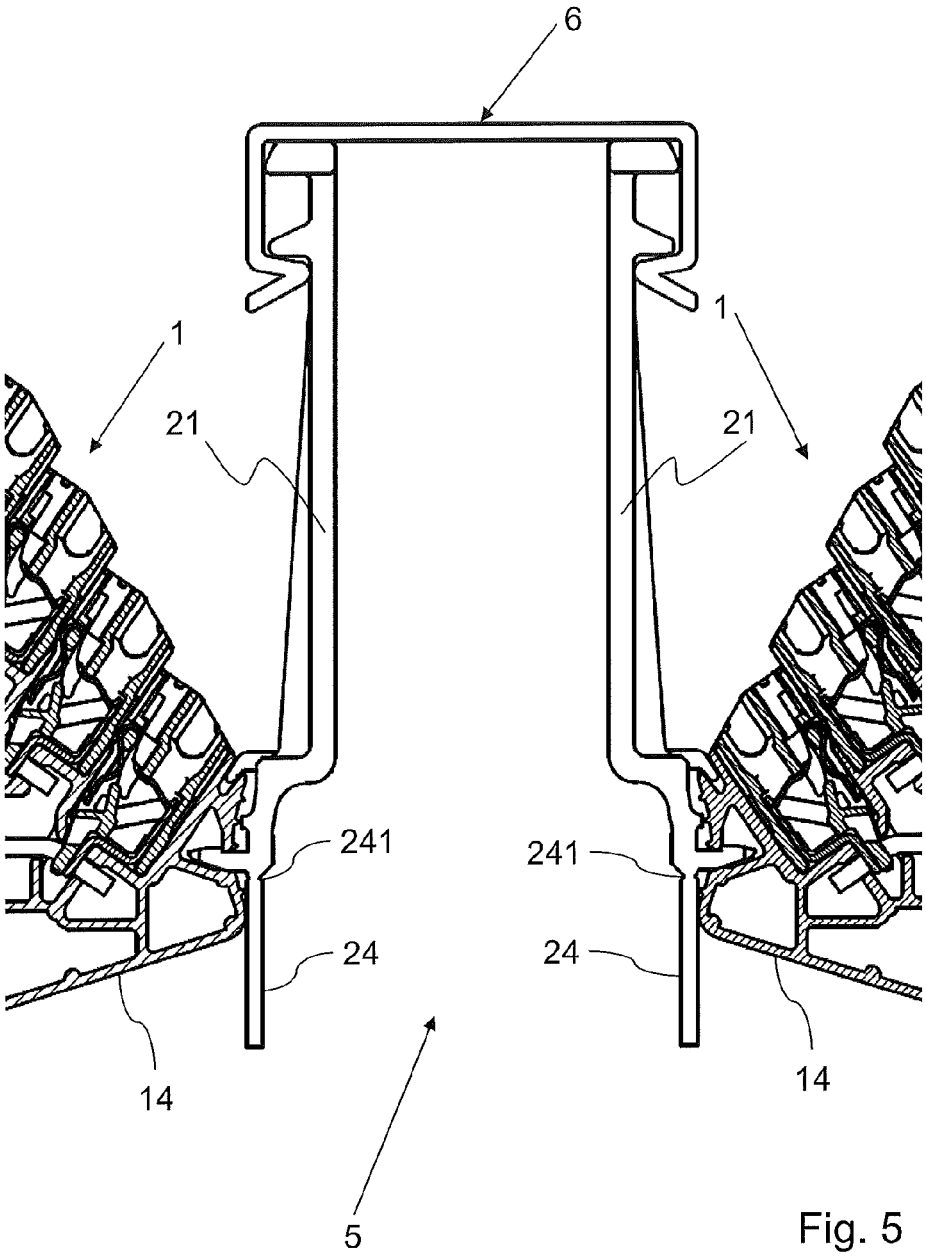
FIG. 5 shows a cable channel with a cover.

FIGS. 2 and 3 show five bars 21 that are combined in one bar assembly group 22, due to a connection plate 23. The bar assembly group may still have a plate-like continuation 24 which is useful, when forming a cable channel 5 (FIG. 5). The upper, free ends of the bars 21 have protrusions 25 between which the guiding slots for the jumper wires are formed. For being able to easily open the guiding slots, the bars 21 are formed fingerlike and elastically flexible. Accordingly, elastically flexible plastic is considered as material for the bars.

Clip-on portions 3 are assigned to the bars 21 which portions are fixed at the connection plate 23, in the shown exemplary embodiment. As may be best seen from FIGS. 3 and 4, each clip-on portion 3 has a pencil-shaped protrusion 31 with a leading-in bevel 311 and an undercut 312 as well as an engagement hook 32. These parts are formed for cooperating with mating clip-on portions 4 at the frame housing. A stop protrusion 33 may still be provided at every bar 21, or at the connection plate 23, respectively. The stop protrusion 33 engages a wall of the frame housing, when the bar, or the bar assembly group, respectively, makes a clip-on connection with the frame housing.

With the bar assembly group shown in FIGS. 2 and 3, there are five pencil-shaped protrusions 31 and four engagement hooks 32. But it shall be understood that every bar 21 each has a pencil-shaped protrusion 31 and an engagement hook 21 at its lower end, or close to the lower end, in the case of individual, separate bars 21 without a connection to adjacent bars.

Figure 4:
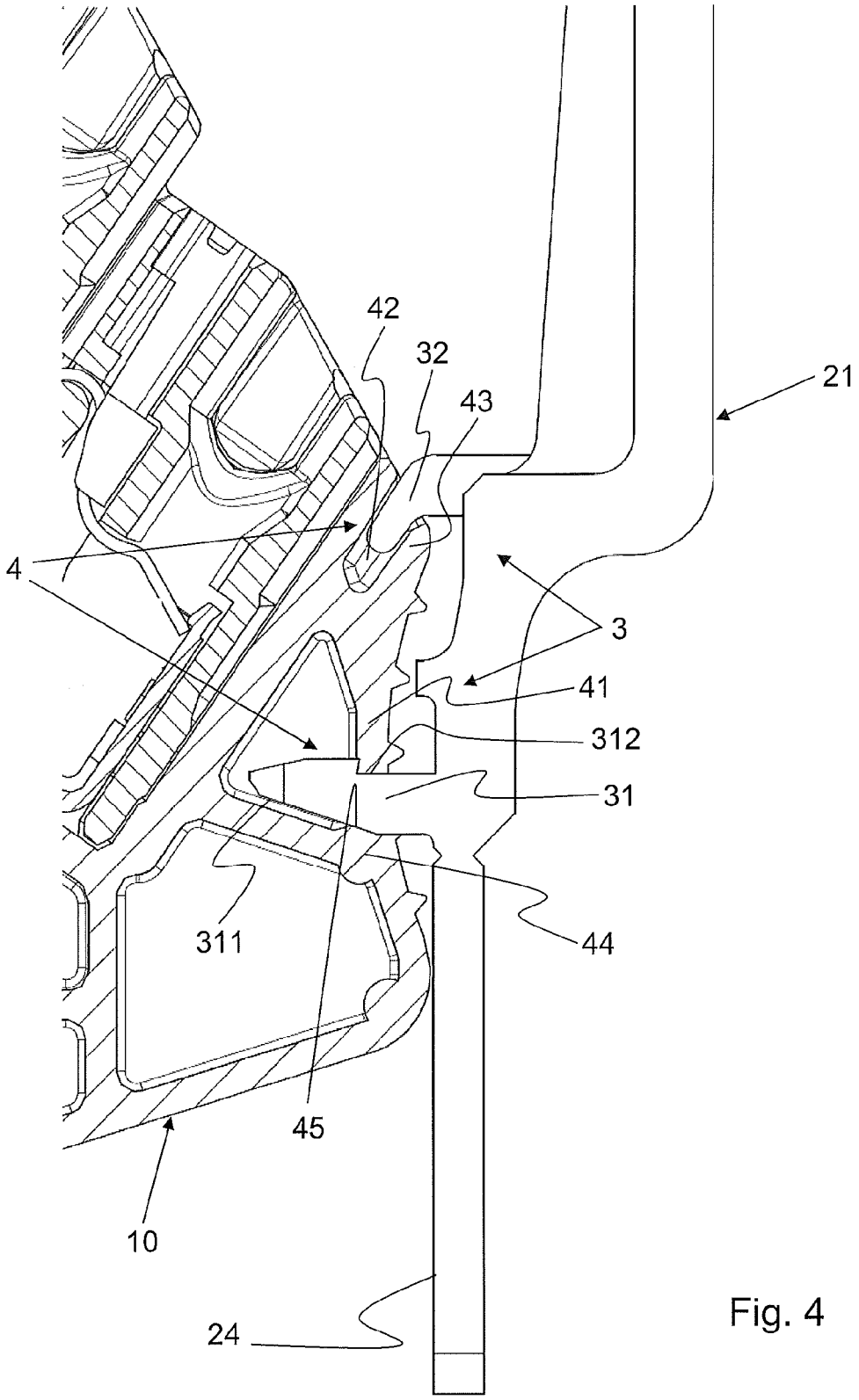
FIG. 4 shows clip-on portions of a bar in engagement with mating clip-on portions at the multi-level terminal block.

The mating clip-on portions 4 comprises a detent spring 41 for cooperating with the pencil-shaped protrusion 31 and an engagement opening 42 for cooperating with engagement hook 32. Between the end of the detent spring 41 and a counter bearing 44, there is a slot opening 45 through which the pencil-shaped protrusion 31 with its leading-in bevels 311 can be slipped. For mounting the bars 21, they are individually or as bar assembly group hooked in the respective engagement opening, using their engagement hook. Then, the respective bar or the bar assembly group are such pivoted that the pencil-shaped protrusion 31 penetrates the slot opening 45, wherein the detent spring 41 backward gives way and then penetrates the undercut 312, as shown in FIG. 4.

For demounting the bars 21, one may bend the detent springs 41 aside, by what it comes clear from the undercut 312, and one may singles out the engagement hook 32 from the opening 42, upward, by lifting the respective bar 21.

Figure 6:
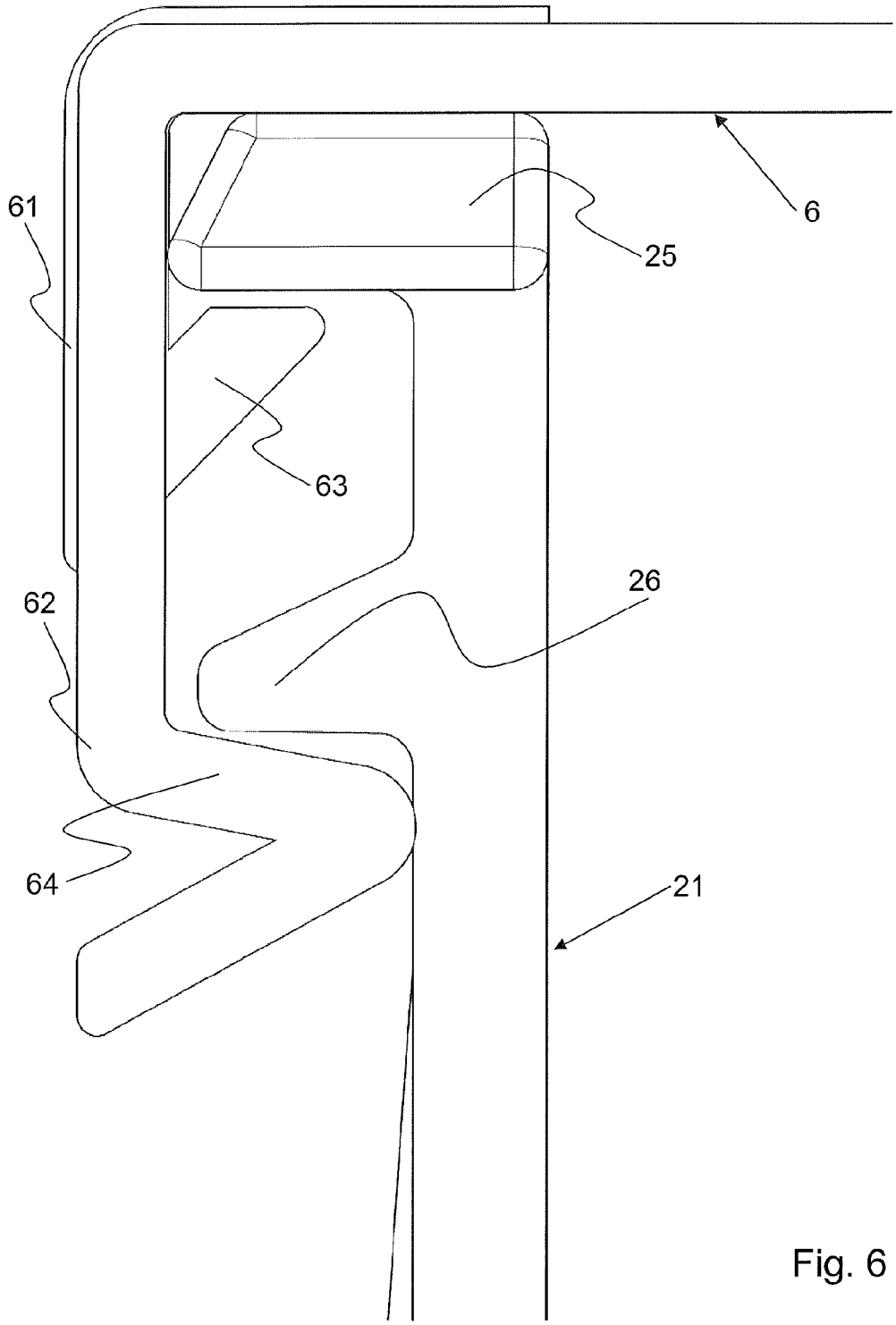
FIG. 6 shows possible embodiments of the cover.

FIG. 5 shows a cable channel 5 put together from bars 21, or bar assembly groups 22, respectively, which are arranged in parallel rows along two multi-level terminal blocks 1. The cable channel 5 and a cover 6 which may be clipped on extend into the drawing layer. In FIG. 6, the cover 6 is presented in two embodiments, but, depending on the manufacturer, there are still further embodiments of the cover. The cover 6 has a clip-on rim 61 or 62 whose lower end is inward bent as counter bearing 63, or 64, respectively. The upper end of every bar 21 has a protrusion 25 behind which the counter bearing 63 abates, in case of the form of the cover 6 with clip-on rim 61. Close to the upper end of the bar 21, there is a further protrusion 26 behind which the counter bearing 64 abates, in case of the form of the cover 6 with clip-on rim 62. Since the material of the fingerlike bars 21 is flexible plastic, the rows of the bars 21 may easily be bent against each other and the cover 6 may be placed onto the protrusions 25 or 26, at the free ends of the bars 21. These protrusions 25 or 26 engage behind the clip-on rim 63 or 64, after relieving the stress of the bars 21.

The protrusion 25 of the bar 21 also extends in the plane of the bars 21 arranged side by side, as may be seen from FIG. 3. For this reason, the protrusions 25 also form a cross bracket narrowing the guiding slots 20 at their upper end. Thus, the jumper wires guided through the guiding slot 20 may not inadvertently upward exit.

As can be seen from FIG. 5, the plate-like continuations 24 form the lower part of the cable channel 5. Depending on from which side the conductor guidance is fixed at the multi-level terminal block 1, right or left (right in FIG. 1), the plate-like continuation 24 may also be broken off and removed, at predetermined breaking points 241. If the foot of the multi-level terminal block itself forms a natural side wall for the cable channel 5, the plate-like continuation 24 is not needed and may at best disturb. With the shown multi-level terminal blocks 1, there are a lower inclined side walls 14 which are covered by the plate-like continuations 24 so that the cables do not inadvertently come under the side walls.

It is apparent to the person skilled in the art that the afore described embodiments have to be understood as examples, and that the invention is not limited to these embodiments, but may varied in a variety of ways without leaving the scope of protection of the claims. Furthermore, it is apparent that the features, notwithstanding, whether they are disclosed in the description, in the claims, in the figures, or otherwise, also individually define essential parts of the present disclosure, even if they are described together with other features.

The invention claimed is:

1. A modular terminal block, in particular a multi-level terminal block, for accommodating connection units and for clamping a plurality of jumper wires which are to be led to individual connection units, the modular terminal block comprising:

a frame housing for connection units to be mounted on top of each other and side by side, and a comb-type structure that forms guiding slots for the jumper wires, wherein the comb-type structure can be put together from separate bars that establish said guiding slots between said separate bars and have clip-on portions, for cooperating with mating clip-on portions at the frame housing such that, if needed, the comb-type structure can be fixed at favoured positions of the modular terminal block, and that these bars may be omitted at favoured positions of the modular terminal block, when no comb-type structure is needed, wherein the clip-on portions include engagement hooks aligned with jumper wire guide slots between the bars, and protrusions aligned with the bars, such that the engagement hooks are spaced apart from the protrusions, and such that there are more protrusions than engagement hooks.

2. The modular terminal block as claimed in claim 1, wherein several bars are combined in a bar assembly group, which bars, as such group, can be clipped onto the frame housing.

3. The modular terminal block as claimed in claim 1, wherein the clip-on portions of the bars have a pencil-shaped protrusion with a leading-in bevel and with an undercut for cooperating with the mating clip-on portions of the frame housing, the mating clip-on portions comprising a detent spring and an engagement opening which cooperate with the pencil-shaped protrusion and with an engagement hook of the clip-on portions.

4. The modular terminal block as claimed in claim 1, wherein the bars have a longish, fingerlike shape and are elastically flexible and each has an upper free end as well as a lower end, wherein the clip-on portions are fixed at the lower end, or close to that lower end.

5. The modular terminal block as claimed in claim 1, wherein a cable channel is formed by two comb-type structures proceeding in parallel to each other and being made up of the bars and by a cover.

6. The modular terminal block as claimed in claim 5, wherein several bars are combined in a bar assembly group clippable onto the frame housing, and wherein the comb-type structures are formed by bar assembly groups which each have a plate-like continuation which can be removed as a result of a predetermined breaking point.

7. The modular terminal block as claimed in claim 1, wherein protrusions are fixed at upper ends of the bars, or close to the upper ends of the bars.

8. A modular terminal block, in particular a multi-level terminal block, for accommodating connection units and for clamping a plurality of jumper wires which are to be led to individual connection units, the modular terminal block comprising:

a frame housing for connection units to be mounted on top of each other and side by side, and a comb-type structure that forms guiding slots for the jumper wires, wherein the comb-type structure can be put together from separate bars that establish said guiding slots between said separate bars and have clip-on portions, for cooperating with mating clip-on portions at the frame housing such that, if needed, the comb-type structure can be fixed at favoured positions of the modular terminal block, and that these bars may be omitted at favoured positions of the modular terminal block, when no comb-type structure is needed, wherein protrusions each of which being effective as cross bracket are formed at the upper free end of the particular bars, or close to that end, the protrusions narrowing the guiding slots formed between the bars, in order to prevent the jumper wires inserted into the guiding slots from coming forth.

9. A modular terminal block, in particular a multi-level terminal block, for clamping a plurality of jumper wires which are to be led to individual connection units, the modular terminal block comprising:

a frame housing for connection units to be mounted on top of each other and side by side, and a comb-type structure for forming guiding slots for the jumper wires, wherein the comb-type structure can be put together from separate bars that have clip-on portions, for cooperating with mating clip-on portions at the frame housing such that, if needed, the comb-type structure can be fixed at favoured positions of the modular terminal block, and that these bars may be omitted at favoured positions of the modular terminal block, when no comb-type structure is needed wherein a cable channel is formed by two comb-type structures proceeding in parallel to each other and being made up of the bars and by a cover, and wherein a protrusion is fixed at the upper end of the particular bars, or close to the upper end, the protrusion extending out of the plane of bars arranged side by side and cooperating with a counter bearing formed at the cover.

10. A multi-level modular terminal block for accommodating connection units and for clamping a plurality of jumper wires, the terminal block comprising:

a frame housing for supporting connection units to be mounted on top and side-by-side with respect to each other, and includes frame housing clip-on portions having first openings and second openings; and a jumper wire guide that couples to and uncouples from the frame housing, guides the jumper wires with respect to the connection units, and includes, a connection plate including clip-on portions having engagement hooks to cooperate with the first openings of the frame housing and protrusions to cooperate with the second openings of the frame housing, and a plurality of bars having lower ends fixed to the connection plate, extending away from the connection plate and terminating in free upper ends, and establishing jumper wire guide slots between the bars, wherein the second openings are established between ends of detent springs of the frame housing and counter bearings of the frame housing.

11. The terminal block as claimed in claim 10, wherein the protrusions include pencil-shaped protrusions with leading-in bevels and undercuts.

12. A multi-level modular terminal block for accommodating connection units and for clamping a plurality of jumper wires, the terminal block comprising:

a frame housing for supporting connection units to be mounted on top and side-by-side with respect to each other, and includes frame housing clip-on portions having first openings and second openings; and a jumper wire guide that couples to and uncouples from the frame housing, guides the jumper wires with respect to the connection units, and includes, a connection plate including clip-on portions having engagement hooks to cooperate with the first openings of the frame housing and protrusions to cooperate with the second openings of the frame housing, and a plurality of bars having lower ends fixed to the connection plate, extending away from the connection plate and terminating in free upper ends, and establishing jumper wire guide slots between the bars, wherein the engagement hooks are aligned with the jumper wire guide slots.

13. The terminal block as claimed in claim 12, wherein the protrusions are aligned with the bars.

14. A multi-level modular terminal block for accommodating connection units and for clamping a plurality of jumper wires, the terminal block comprising:

a frame housing for supporting connection units to be mounted on top and side-by-side with respect to each other, and includes frame housing clip-on portions having first openings and second openings; and a jumper wire guide that couples to and uncouples from the frame housing, guides the jumper wires with respect to the connection units, and includes, a connection plate including clip-on portions having engagement hooks to cooperate with the first openings of the frame housing and protrusions to cooperate with the second openings of the frame housing, and a plurality of bars having lower ends fixed to the connection plate, extending away from the connection plate and terminating in free upper ends, and establishing jumper wire guide slots between the bars, wherein the engagement hooks are aligned with the jumper wire guide slots, and the protrusions are aligned with the bars, such that the engagement hooks are spaced apart from the protrusions, and such that there are more protrusions than engagement hooks.

* * * * *